US006447348B1

(12) United States Patent
Gilley

(10) Patent No.: US 6,447,348 B1
(45) Date of Patent: Sep. 10, 2002

(54) TROLLING MOTOR FOR WATERCRAFT AND METHOD OF MOUNTING THE SAME

(75) Inventor: Jeff Gilley, Cumming, GA (US)

(73) Assignee: Row Less Play More Corporation, Cumming, GA (US)

( * ) Notice: Subject to any disclaimer, the term of this patent is extended or adjusted under 35 U.S.C. 154(b) by 0 days.

(21) Appl. No.: 09/780,881

(22) Filed: Feb. 9, 2001

(51) Int. Cl.[7] ..... B63H 21/17
(52) U.S. Cl. ..... 440/6; 440/62; 440/63
(58) Field of Search ..... 440/6, 7, 53, 58, 440/62, 63; 114/347

(56) References Cited

U.S. PATENT DOCUMENTS

| | | | | |
|---|---|---|---|---|
| 3,895,276 A | * | 7/1975 | Brown et al. | 318/811 |
| 3,930,461 A | * | 1/1976 | Brock et al. | 248/642 |
| 3,980,039 A | | 9/1976 | Henning | 115/41 R |
| 4,634,390 A | * | 1/1987 | Baird | 248/642 |
| 4,820,208 A | | 4/1989 | Phillips, Sr. | 440/7 |
| 5,112,258 A | | 5/1992 | Folsom | 440/63 |
| 5,174,542 A | | 12/1992 | DeLeeuw, Jr. | 248/640 |
| 5,725,401 A | | 3/1998 | Smith | 440/6 |
| 5,743,773 A | | 4/1998 | Saito et al. | 440/53 |

* cited by examiner

*Primary Examiner*—Sherman Basinger
(74) *Attorney, Agent, or Firm*—Troutman Sanders LLP; Wm. Brook Lafferty

(57) ABSTRACT

An outboard trolling motor operable to turn a propeller for direction control and raise and lower the propeller relative to the waterline. The present invention includes an elongated member for carrying the propeller. Upper and lower planer members are pivotally connected to one another. The upper member is adapted to pivot between raised and lowered positions relative to the lower member and the elongated member is coupled to the distal end of the upper member. A driver rotates the elongated member relative to the upper and lower members and another driver raises and lowers the upper member into raised and lowered positions, respectively. The propeller is adapted to be positioned below the waterline when the upper member is in the lowered position and above the waterline when the upper member is in the raised position.

16 Claims, 5 Drawing Sheets

TROLLING MOTOR FOR WATERCRAFT AND METHOD OF MOUNTING THE SAME

TECHNICAL FIELD

The present invention relates to trolling motors and, more specifically, to the manner of raising, lowering and rotating the trolling motor during use.

BACKGROUND OF THE INVENTION

Currently, there is a variety of trolling motors available to watercraft users. The positioning of the trolling motor is critical is the performance of the watercraft in the water. These known trolling motors are typically mounted on the side or stern of the watercraft. However, it is preferable to mount the trolling motor on the stem of the watercraft along the watercraft's centerline. Positioning the trolling motor on the centerline prevents rocking of the watercraft which occurs when the trolling motor is positioned on the side of the watercraft and, therefore, displaced from the centerline. Moreover, it is desirable to generate thrust along the centerline of the watercraft for efficiency.

However, it is difficult to maximize thrust by placing the trolling motor along the centerline while also controlling placement of the trolling motor relative to the waterline as well as the direction of the propeller on the trolling motor. This is often because of the manner in which the trolling motor is mounted to the watercraft. Typically, only one of these performance characteristics is favored in the known designs in order to maintain a compact and useful design.

Therefore, there is a need in the trolling motor industry for an improved trolling motor which may be more easily mounted at the end of a watercraft. The new trolling motor must permit raising and lowering of a propeller relative to the waterline while also permitting the turning of the trolling motor in order to turn the watercraft.

SUMMARY OF THE INVENTION

The present invention solves the above-identified problem by providing an improved trolling motor. The improved trolling motor is more easily utilized by watercraft users by the manner in which it allows for directional control of the propeller to turn the watercraft as well as the raising and lowering of the propeller relative to the waterline.

Generally described, the trolling motor of the present invention includes an elongated member for carrying the propeller. Upper and lower planar members are pivotally connected to one another. The upper member is adapted to pivot between raised and lowered positions relative to the lower member and the elongated member is coupled to the distal end of the upper member. A driver rotates the elongated member relative to the upper and lower members and another driver raises and lowers the upper member into raised and lowered positions, respectively. The propeller is adapted to be positioned below the waterline when the upper member is in the lowered position and above the waterline when the upper member is in the raised position.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
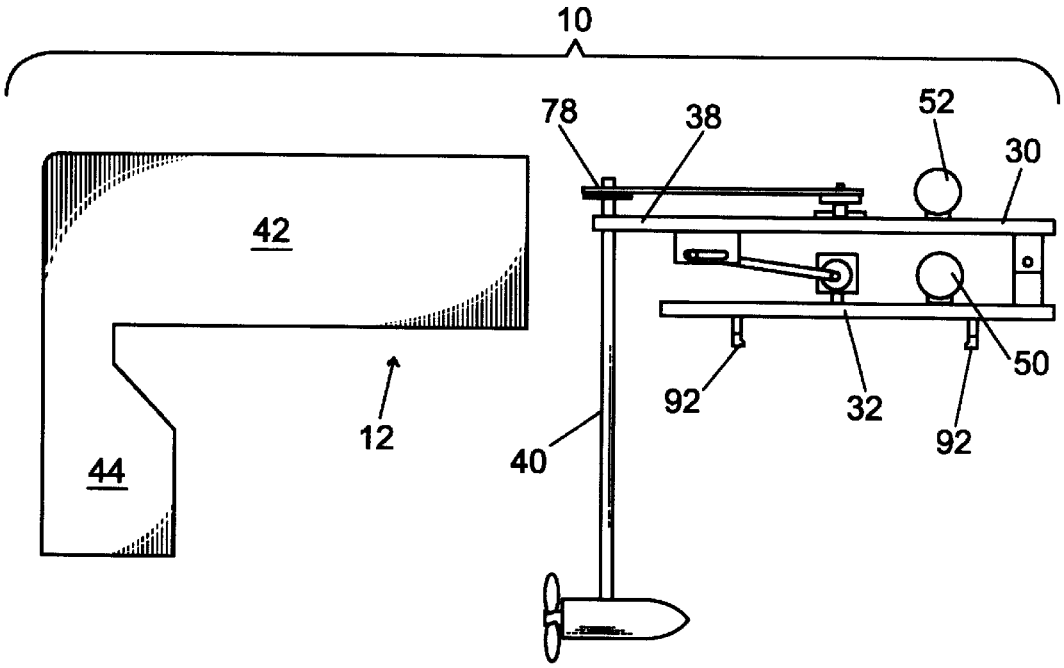
FIG. 1 is a partially exploded view of one embodiment of the trolling motor of the present invention.
Figure 2:
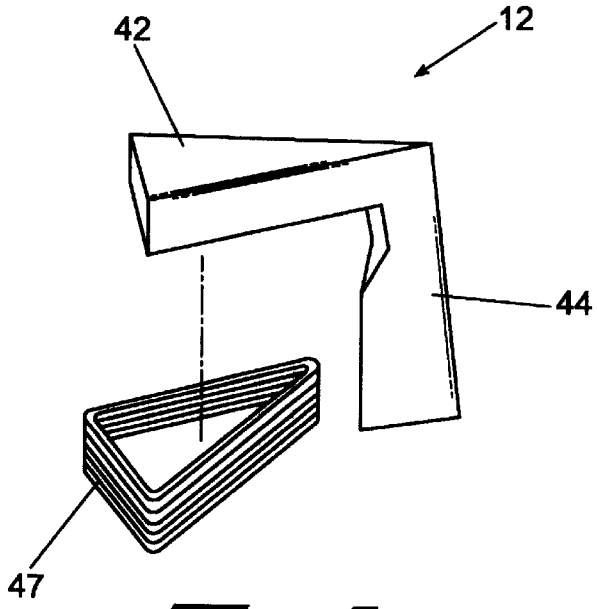
FIG. 2 is a perspective view of one embodiment of the shroud of the trolling motor in FIG. 1.
Figure 3:
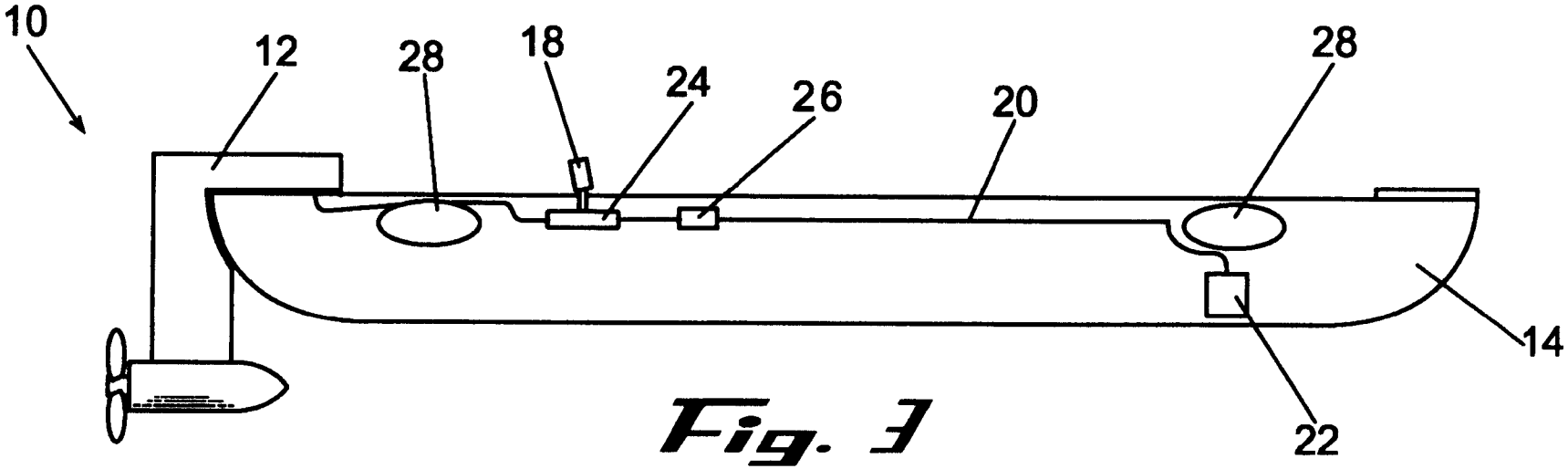
FIG. 3 is a front view of one embodiment of a watercraft having the trolling motor of FIG. 1.

Referring now to the drawings in which like numerals indicate like elements throughout the several views, FIG. 1 depicts one embodiment of an electronic trolling motor 10 of the present invention. The trolling motor 10 preferably includes a shroud 12 configured as shown in FIG. 2. As shown in FIG. 3, the trolling motor 10 with shroud 12 is preferably placed on the stern end of a watercraft 14 such as a canoe. The trolling motor 10 is configured to permit its placement along the centerline of the watercraft 14.

Still referring to FIG. 3, the trolling motor 10 includes a wiring harness 20, battery 22 and control panel 24. The battery 22 and control panel 24 may be removed from the watercraft 14, along with the trolling motor 10, when the watercraft 14 is not in use. The trolling motor 10 is reversible and may provide any type of thrust. The trolling motor of the present invention is configured to permit its removal from the watercraft 14 and its packing away in an economy of space such as in a storage case. However, the wiring harness 20 is preferably permanently mounted on the inside of the watercraft 14 along what is commonly referred to as the gunwale. A disconnect 26 is provided which allows the control panel 24 to easily be removed. The control panel 24 is placed on the gunwale between the seats 28 nearest the rear or captain's seat. Preferably, the control panel 24 includes a joystick 18 to facilitate control of the watercraft 14 via the trolling motor 10. The control panel 24 also includes circuitry for controlling the amount of thrust as well as for reversing direction.

Now referring back to FIG. 1, the trolling motor 10 also includes a pair of planar members 30 and 32. The upper most planar member is preferably referred to as the upper planar member 30 and the lower most planar member is preferably referred to as the lower planar member 32. Also, each of the planar members 30, 32 are configured to correspond with a deck portion (FIG. 7) of the watercraft 14.

Figure 6:
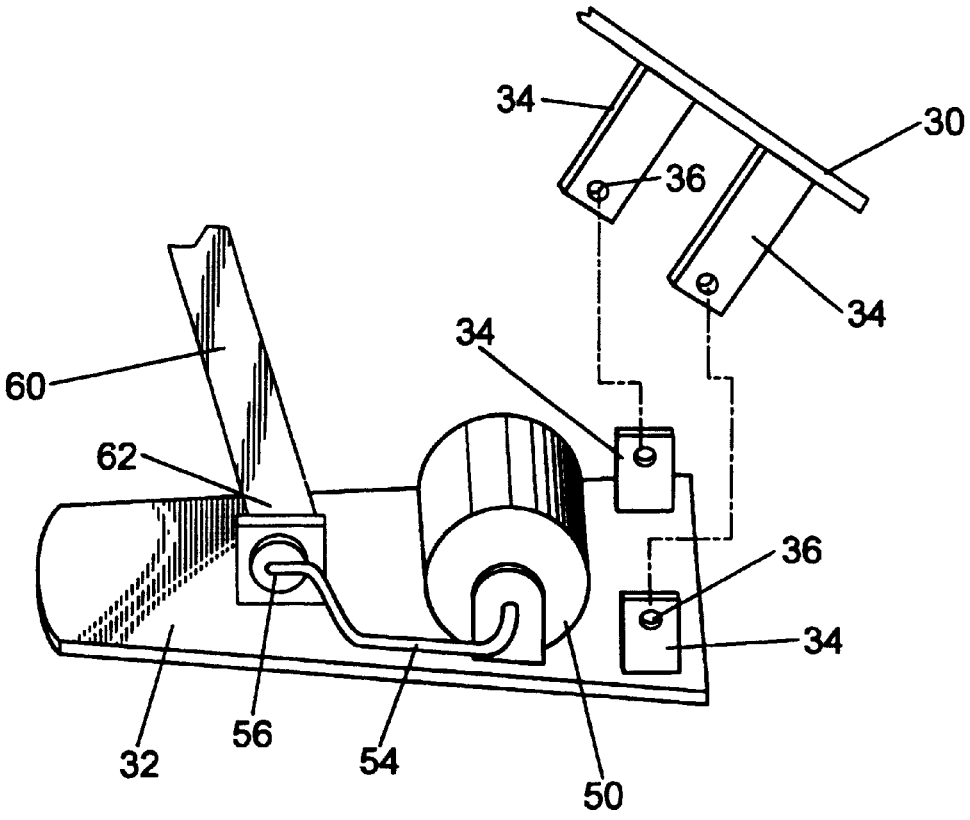
FIG. 6 is a partially exploded, perspective view illustrating one embodiment of a lower planer member of the trolling motor of FIG. 1.

The upper and lower members 30, 32 are pivotally connected to one another at their proximal ends. Preferably, a pair of flanges 34 on each planar member extend inward toward the other planar member (FIG. 6). At the distal end of each flange is an opening 36 therethrough. The openings 36 in the flanges 34 on the lower member 32 correspond with the openings 36 in the flanges 34 on the upper member 30 so that fasteners may be placed through the corresponding openings 36 (FIG. 6). Nylon spacers may be used to facilitate the pivoting between the upper and lower members 30, 32.

Figure 4:
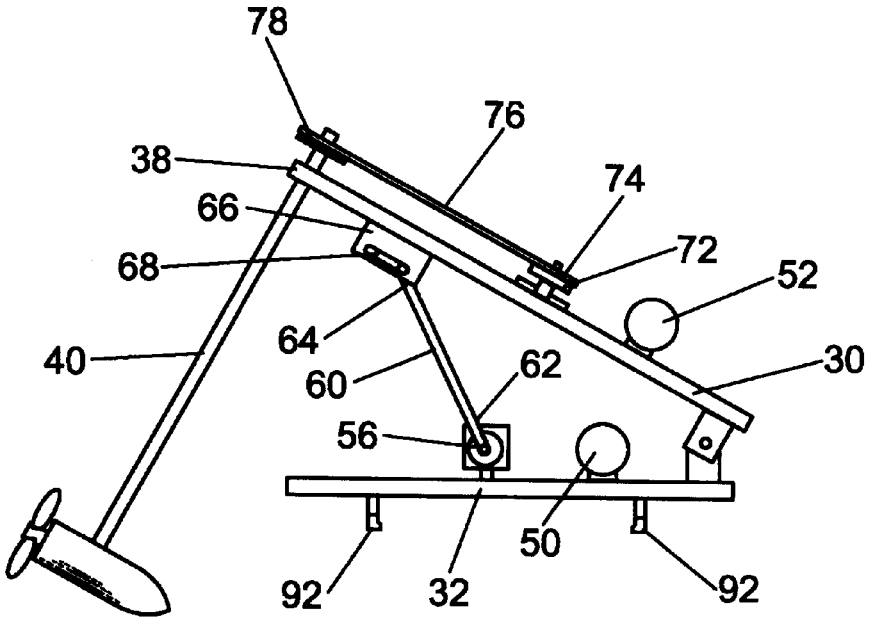
FIG. 4 is a front view of one embodiment of the trolling motor of the present invention in the raised position.

On a distal end 38 of the upper member is rotatably mounted an elongated member 40 for carrying the propeller. The upper member 30 may pivot relative to the lower member 32 between lowered and raised positions as shown in FIGS. 1 and 4, respectively. As shown in FIG. 1, in the lowered position, the upper and lower members 30, 32 are substantially parallel to one another. In the lowered position, the elongated member 40 is maintained in substantially a vertically oriented manner so that the propeller is positioned to propel the watercraft 14 through the water. However, as shown in FIG. 4, the pivoting of the upper member 30 into the raised position tilts the elongated member 40 so that the propeller may be raised above the waterline.

The shroud 12 includes an upper portion 42 and a lower portion 44. The upper portion 42 houses the upper and lower members 30, 32 with drivers when the trolling motor 10 is in the lowered position. However, when the trolling motor 10 is raised into the raised position, the shroud 12 may expose a protective bellows 47 that protects the electronics from the elements. The bellows 47 is expandable and is preferably sealed to the underside of upper planar member 30 and extends down to be sealed around the periphery of the lower planar member 32. In both the lowered and raised portions, lower portion 44 of the shroud 12 extends along the length of the elongated member 40 down to the propeller as best shown in FIG. 3.

In order to raise and lower the propeller on the elongated member 40 relative to the waterline as explained above, a driver such as an electronic cable-drive motor is mounted to the lower member. Suitable electronic cable-drive motors, such as those used to provide movement to an automobile seat, are available from any automobile parts supplier. As shown in FIGS. 4 and 6, a driver 50 is mounted on the lower member 32. The orientation of the driver 50 on the lower member 32 is that which allows the driver 50 to remain within the perimeter of the lower member 32. However, as shown in FIG. 6, cable 54 extending from the driver 50 should be able to reach and attach to a gear box 56 which is also mounted on the lower member 32. The gear box 56 may also be found at automotive parts suppliers and are typically sold alongside the drivers. The gear box is preferably geared to move slowly but to carry the maximum amount of weight. Alternatively, a ram-device may be substituted for the driver 50, cable 54, gear box 56 and elongated arm 60.

From the gear box 56 extends an elongated arm 60. One end 62 of the arm is fixed to the gear box 56 and another end 64 is coupled to the bottom of the upper member 30. Preferably, in order to allow the arm 60 to raise the upper member 30 properly, a flanged portion 66 downwardly extends from the bottom of the upper member 30. The flanged portion 66 includes an elongated slot 68 therethrough for receiving a bushing on the other end 64 of the arm. The length of the elongated slot 68 is determined by the amount the upper member 30 needs to be raised and lowered and the length of the arm 60. This end 64 of the arm 60 preferably includes a fastener that permits the arm to be retained in the elongated slot 68 as well as slide in the elongated slot 68. Alternatively, a ram-device may be substituted for the driver 50, cable 54, gear box 56 and elongated arm 60.

Figure 5:
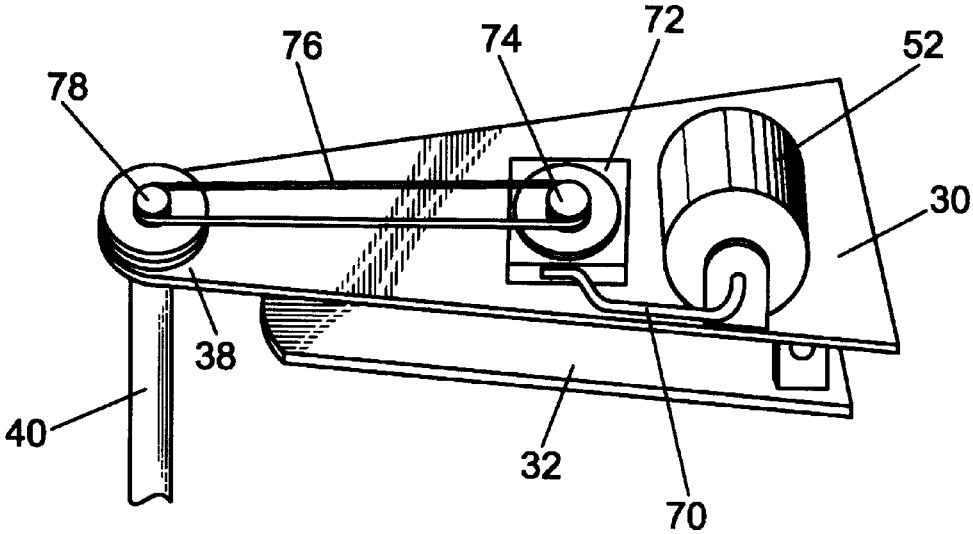
FIG. 5 is a partial top perspective view illustrating one embodiment of an upper planer member of the trolling motor of FIG. 1.

As best shown in FIG. 5, another driver 52 is mounted on the upper member 30 in order to rotate the elongated member 40 relative to the upper and lower members 30, 32. A cable 70 from the driver 52 extends over to another gear box 72 fitted with a drive pulley 74 or sheaves for the transmission of rotary mechanical power to the elongated member 40 via a chain or belt 76. The gearing of the gear box 72 is also preferably geared to move slowly but provide the maximum torque. The drive pulley 74 is in alignment with a pulley 78 on the upper end of the elongated member 40 to preserve the operating life of the belt 76 and the rest of the drive system of rotating the elongated member 40 to turn the watercraft 14. An adjustable block may be used between the gear box 72 and the lower member 32 so that the gear box 72 may be moved to change the belt 76. Moreover, adjustable blocks may also be utilized under the gear box 56 or either of the drivers 50, 52 to allow for adjustments.

The drivers 50, 52 are electrically coupled into the wiring harness 20 and are controlled by the control panel 24. The speed and the direction of rotation of the propeller on the end of the elongated member 40 is also controlled by the control panel 24. The wiring of the driver powering the propeller preferably passes through a hollow interior of the elongated member 40 and then extends from the trolling motor 10 along with the wiring from the drivers 50, 52 to be coupled into the wiring harness 20. Preferably, the drivers 50, 52 and the wiring from the propeller are electrically coupled directly into the control panel 24 and then coupled into the wiring harness 20 via the disconnect 26. In order to remove the trolling motor 10 and control panel 24 from the watercraft 14, the disconnect 26 is separated from the wiring harness 20.

Figure 7:
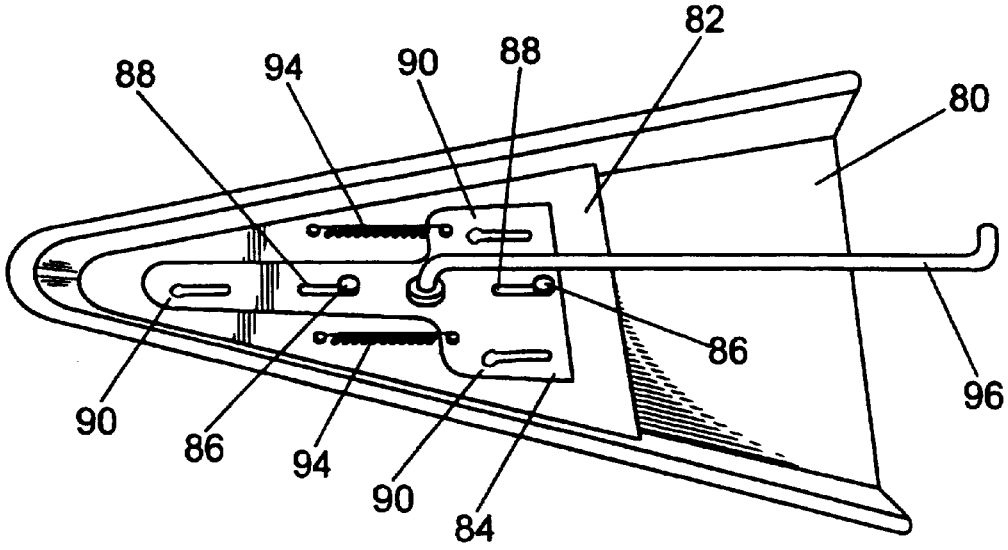
FIG. 7 is a perspective view of one embodiment of the underside of a double-ended deck portion hang a mechanism for detachably mounting the trolling motor of the present invention.

FIG. 7 illustrates one embodiment of a typical deck portion 80 of a double-ended watercraft having a mechanism for detachably mounting the trolling motor 10 to the watercraft 14. A planar member 82 is configured to correspond with the underside of the deck portion 80 when attached to one another as shown in FIG. 7. A translating member 84 is attached to the planar member 82 with a pair of fasteners 86 to permit the translating member 84 to translate relative to the planar member 82 between locked and unlocked positions. The fasteners 86 are fixed in the planar member 82 but extend through elongated openings 88 in the translating member 84.

However, the translating member 84 includes another set of elongated openings 90 which correspond with a set of elongated openings 90 in the planar member 82. These later two sets of openings 90 are commonly referred to as keyhole openings because they are sized and cooperate with one another to receive and retain a corresponding set of lock pins 92 which extend downward from the bottom of the lower member 32. The lock pins are best shown in FIGS. 1 and 4. The keyhole openings 90 cooperate in such a manner as to retain the lock pins 92 when the translating member 84 is in the locked position and to release the lock pins 92 when the translating member 84 is in the unlocked position. Preferably, the translating member 84 is biased to remain in the locked position with a pair of springs 94 which are attached at their ends between the planar member 82 and the translating member 84 as shown on FIG. 7. An elongated member 96 shaped to provide a handle suitable for pulling is mounted to the translating member 84. Pulling on the handle-shaped member 96 moves the translating member 84 and configures the opening 90 to receive the lock pins 92. The handle-shaped elongated member 96 is preferably long enough to extend out from underneath the deck portion 80 when the deck portion 80 is attached to the watercraft 14.

Figure 8:
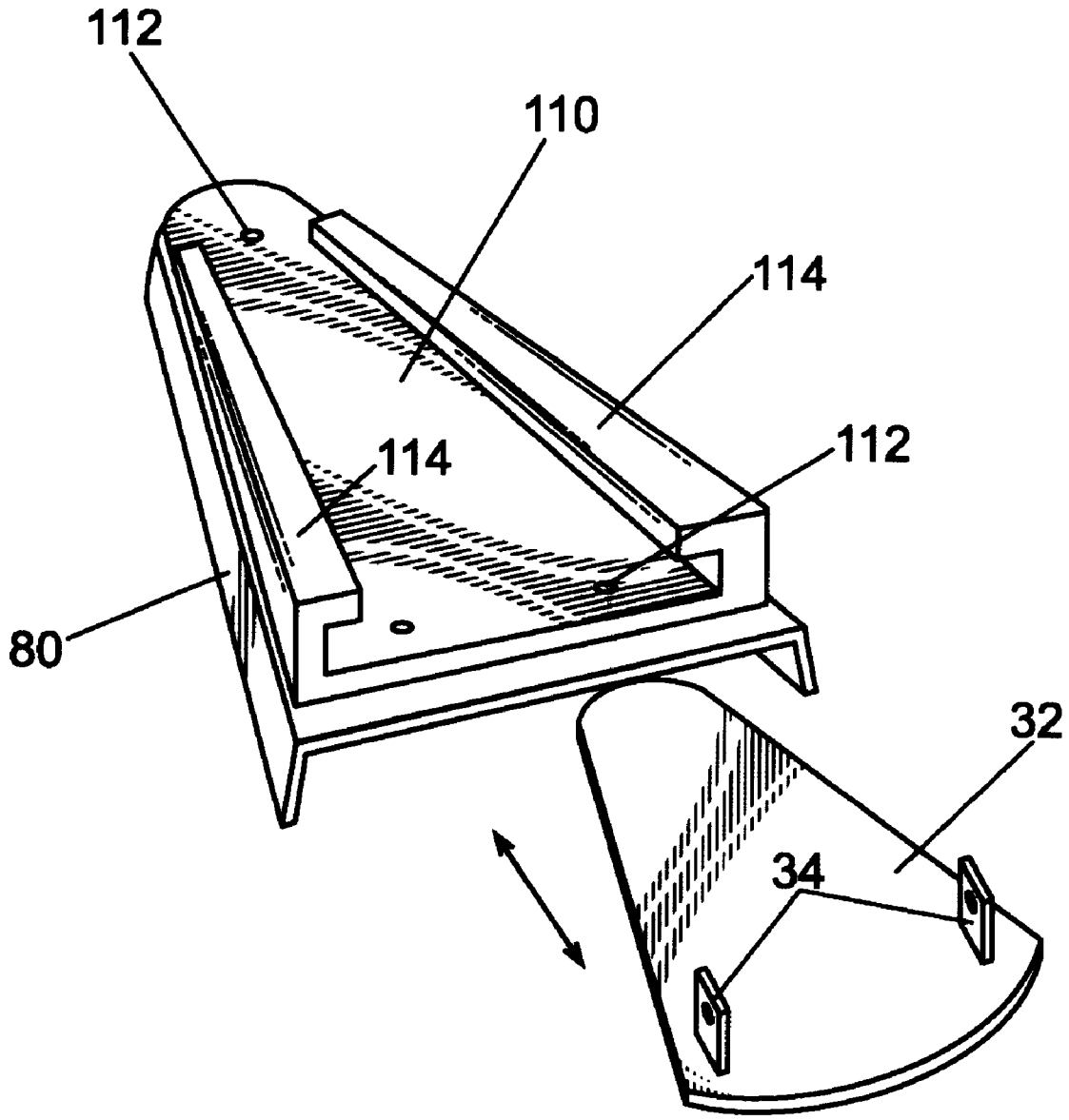
FIG. 8 is a perspective view of an alternative device for detachably mounting the trolling motor of the present invention.

Alternatively, a quick release bracket 110 may be used instead of the mechanism shown in FIG. 7. The quick release bracket 110 is fastened to the deck portion 80 with fasteners 112 and is preferably substantially triangularly shaped, as shown in FIG. 8, so as to correspond with the shape of the lower planar member 32 and deck portion 80. The edges are rolled over to define channels 114 along the sides of the bracket 110. The channels 114 are sized to receive the thickness of the lower planar member 32. In operation, the trolling motor 10 is mounted to the watercraft by sliding the lower planar member 32 into the bracket 110 until the side edges of the lower planar member are completely received by the channels 114. To remove the trolling motor 10, the lower planar member 32 is slid out of the bracket 110.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. An outboard trolling motor for driving a propeller to propel a watercraft, said outboard trolling motor comprising:

an elongated member for carrying the propeller;

an upper member having proximal and distal ends;

a lower member having proximal and distal ends, said upper and lower members pivotally connected to one another at said proximal ends, said upper member adapted to pivot between raised and lowered positions relative to said lower member, said elongated member coupled to said distal end of said upper member;

means mounted intermediate the ends of said upper member for rotating said elongated member relative to said upper and lower members to turn the watercraft, and means for raising and lowering said upper member into said raised and lowered positions, respectively, wherein the propeller is adapted to be positioned below the waterline when said upper member is in said lowered position and above the waterline when said upper member is in said raised position.

2. The trolling motor of claim 1 wherein said troller motor is detachably mounted along the centerline of the watercraft.

3. The trolling motor of claim 1 wherein said means for raising and lowering said upper member into said raised and lowered positions is mounted to said lower member.

4. The trolling motor of claim 1 wherein said means for rotating said elongated member relative to said upper and lower members comprises a driver, said driver coupled to said elongated member.

5. The trolling motor of claim 4 wherein said driver comprises an electric cable-drive motor coupled to a gear housing, said gear housing coupled to said elongated member.

6. The trolling motor of claim 5 wherein said gear housing is coupled to said elongated member with a belt.

7. The trolling motor of claim 1 wherein said means for raising and lowering said upper member into said raised and lowered positions comprises a driver, said driver raising and lowering an arm to place said upper member in said raised and lowered positions, respectively.

8. The trolling motor of claim 7 wherein said driver comprises a electric cable-drive motor coupled to a gear housing, said gear housing coupled to said arm.

9. The trolling motor of claim 1 detached from the watercraft and packed in an economy of space for storage.

10. The trolling motor of claim 9 further comprising a wiring harness permanently attached to the watercraft.

11. The trolling motor of claim 1 wherein said trolling motor is detachably mounted along the centerline of a canoe.

12. An outboard trolling motor for driving a propeller to propel a watercraft, said outboard trolling motor comprising:

an elongated member for carrying the propeller;

an upper member having proximal and distal ends;

a lower member having proximal and distal ends, said upper and lower members pivotally connected to one another, said upper member adapted to pivot between raised and lowered positions relative to said lower member; and a shroud for at least partially housing said upper and lower members and extending at least partially along the length of said elongated member.

13. An outboard trolling motor for driving a propeller to propel a watercraft, said outboard trolling motor comprising:

an elongated member for carrying the propeller;

an upper member having proximal and distal ends;

a lower member having proximal and distal ends, said upper and lower members pivotally connected to one another, said upper member adapted to pivot between raised and lowered positions relative to said lower member; and a flanged portion extends from said upper member, said flanged portion comprising an elongated slot therethrough for coupling to an end of an said end of said arm moving the length of said slot while said upper member is raised and lowered into said raised and lowered positions, respectively.

14. An outboard trolling motor for driving a propeller to propel a watercraft, said outboard trolling motor comprising:

an elongated member for carrying the propeller;

an upper member having proximal and distal ends;

a lower member having proximal and distal ends, said upper and lower members pivotally connected to one another, said upper member adapted to pivot between raised and lowered positions relative to said lower member; and a mounting mechanism for mounting said trolling motor to the watercraft, said mounting mechanism comprising a planar member and a translating member, said planar member configured to be coupled with a deck portion of the watercraft, said translating member adapted to translate relative to said planar member between locked and unlocked positions, said translating member biased to remain in said locked position, said planar member and said translating member each comprising openings sized for receiving and retaining pins coupled to said trolling motor, and said openings in said planar member cooperating with said openings in said translating member to retain said pins when said translating member is in said locked position and to release said pins when in said unlocked position.

15. An outboard trolling motor for driving a propeller to propel a watercraft, said outboard trolling motor comprising:

an elongated member for carrying the propeller;

an upper member having proximal and distal ends;

a lower member having proximal and distal ends, said upper and lower members pivotally connected to one another, said upper member adapted to pivot between raised and lowered positions relative to said lower member, and a protective bellows coupled between said upper and lower members.

16. An outboard trolling motor for driving a propeller to propel a watercraft, said outboard trolling motor comprising:

an elongated member for carrying the propeller;

an upper member having proximal and distal ends;

a lower member having proximal and distal ends, said upper and lower members pivotally connected to one another at said proximal ends, said upper member adapted to pivot between raised and lowered positions relative to said lower member, said elongated member coupled to said distal end of said upper member;

a driver mounted intermediates the ends of to said upper member for rotating said elongated member relative to said upper and lower members to turn the watercraft to turn the watercraft; and a driver mounted to said lower member for raising and lowering said upper member into said raised and lowered positions, wherein the propeller is adapted to be positioned below the waterline when said upper member is in said lowered position and above the waterline when said upper member is in said raised position.

* * * * *